US012442198B2

(12) United States Patent
Timothy

(10) Patent No.: US 12,442,198 B2
(45) **Date of Patent: *Oct. 14, 2025**

(54) DECK CLIP

(71) Applicant: PrimeSource Building Products, Inc., Irving, TX (US)

(72) Inventor: E. Erik Timothy, Apollo Beach, FL (US)

(73) Assignee: PrimeSource Building Products, Inc., Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/639,288

(22) Filed: Apr. 18, 2024

(65) Prior Publication Data

US 2024/0263460 A1 Aug. 8, 2024

Related U.S. Application Data

(63) Continuation of application No. 17/974,755, filed on Oct. 27, 2022, now Pat. No. 12,297,649.

(51) Int. Cl.
*E04F 15/02* (2006.01)

(52) U.S. Cl.
CPC ..... *E04F 15/02044* (2013.01); *E04F 2015/02122* (2013.01)

(58) Field of Classification Search
CPC ..... E04F 15/02044; E04F 15/02183; E04F 2015/02088; E04F 2015/02094; E04F 2015/02122
See application file for complete search history.

(56) References Cited

U.S. PATENT DOCUMENTS

| | | | |
|---|---|---|---|
| 876,399 | A | 1/1908 | Robinson |
| 877,831 | A | 1/1908 | Creedon |
| 984,323 | A | 2/1911 | Vauclain |

(Continued)

FOREIGN PATENT DOCUMENTS

| | | | |
|---|---|---|---|
| AT | 406894 | B | 10/2000 |
| AU | 4481579 | A | 10/1979 |

(Continued)

OTHER PUBLICATIONS

Deck Fastener, Instruction Sheet, https://web.archive.org/web/20020721042351/http://deckfastener.com/images/instructionsheet.jpg). Jul. 21, 2002, Accessed Sep. 4, 2024.

(Continued)

*Primary Examiner* — Christine T Cajilig
(74) *Attorney, Agent, or Firm* — Husch Blackwell LLP

(57) ABSTRACT

A deck clip that may be used in the construction of a deck and a method of using the same is provided. The deck clip may include a grip and a spacer. Portions of both the grip and the spacer may be received within the grooves of deck boards used in decks. Thus, the deck clip may be selectively affixed to deck boards. Further, the deck clip may be configured to receive a fastener for anchoring the deck clip to joists. Thus, the deck clip may be used to couple deck boards to joists. Advantageously, the deck clip may be used to construct a deck without exposed fasteners, the geometry of the spacer may assist with creating a consistent gap between adjacent deck boards, and the grip may comprise saw-tooth shaped surfaces for improved retention of the deck boards.

8 Claims, 13 Drawing Sheets

(56) References Cited

U.S. PATENT DOCUMENTS

| | | | |
|---|---|---|---|
| 1,714,738 | A | 5/1929 | Smith |
| 1,879,459 | A | 9/1932 | Pelton |
| 1,888,611 | A | 11/1932 | Wolfson |
| 2,065,525 | A | 12/1936 | Hamilton |
| 2,066,813 | A | 1/1937 | Williams |
| 2,116,737 | A | 5/1938 | Urbain |
| 2,129,976 | A | 9/1938 | Urbain et al. |
| 2,338,870 | A | 1/1944 | Praeger |
| 2,369,961 | A | 2/1945 | Gisondi |
| 2,620,705 | A | 12/1952 | Papa et al. |
| 2,774,969 | A | 12/1956 | Samples |
| 2,994,878 | A | 8/1961 | Abrahamsen |
| 3,010,496 | A | 11/1961 | Bruce |
| 3,012,247 | A | 12/1961 | Sillars et al. |
| 3,020,602 | A | 2/1962 | Siering |
| 3,147,484 | A | 9/1964 | Nelson |
| 3,177,755 | A | 4/1965 | Kahn |
| 3,207,023 | A | 9/1965 | Knohl |
| 3,237,360 | A | 3/1966 | Mills |
| 3,267,630 | A | 8/1966 | Omholt |
| 3,284,117 | A | 11/1966 | Meehan |
| 3,316,949 | A | 5/1967 | Canfield |
| 3,331,180 | A | 7/1967 | Vissing et al. |
| 3,357,295 | A | 12/1967 | Smith |
| 3,360,176 | A | 12/1967 | Gehl et al. |
| 3,439,464 | A | 4/1969 | Omholt |
| 3,553,919 | A | 1/1971 | Omholt |
| 3,577,694 | A | 5/1971 | Omholt |
| 3,619,963 | A | 11/1971 | Omholt |
| 3,671,017 | A | 6/1972 | Sachs |
| 3,713,264 | A | 1/1973 | Morgan |
| 3,738,218 | A | 6/1973 | Gutshall |
| 3,760,547 | A | 9/1973 | Brenneman |
| 3,942,405 | A | 3/1976 | Wagner |
| 4,023,831 | A | 5/1977 | Thompson |
| 4,062,388 | A | 12/1977 | Decaro |
| 4,068,554 | A | 1/1978 | Hirabayashi |
| 4,117,644 | A | 10/1978 | Weinar |
| 4,123,186 | A | 10/1978 | Hoadley |
| 4,125,006 | A | 11/1978 | Bueche |
| 4,125,972 | A | 11/1978 | Pate |
| 4,126,006 | A | 11/1978 | Lewis |
| 4,146,071 | A | 3/1979 | Mueller et al. |
| 4,154,172 | A | 5/1979 | Curtis, Jr. |
| 4,170,430 | A | 10/1979 | Mrotzek |
| 4,209,275 | A | 6/1980 | Kim |
| 4,266,914 | A | 5/1981 | Dickinson |
| 4,272,938 | A | 6/1981 | Seipos |
| 4,281,494 | A | 8/1981 | Weinar |
| 4,323,326 | A | 4/1982 | Okada et al. |
| 4,329,099 | A | 5/1982 | Shimizu et al. |
| 4,333,286 | A | 6/1982 | Weinar |
| 4,435,935 | A | 3/1984 | Larrea |
| 4,439,077 | A | 3/1984 | Godsted |
| 4,448,007 | A | 5/1984 | Adams |
| 4,467,579 | A | 8/1984 | Weinar |
| 4,497,148 | A | 2/1985 | Lopez |
| 4,498,272 | A | 2/1985 | Adams |
| 4,534,690 | A | 8/1985 | Barth |
| 4,572,720 | A | 2/1986 | Rockenfeller et al. |
| 4,625,597 | A | 12/1986 | Cast |
| 4,653,244 | A | 3/1987 | Farrell |
| 4,677,703 | A | 7/1987 | Yamasaki |
| 4,701,066 | A | 10/1987 | Beam et al. |
| 4,703,601 | A | 11/1987 | Abendroth |
| 4,776,144 | A | 10/1988 | Pardo |
| 4,831,808 | A | 5/1989 | Wynar |
| 4,834,602 | A | 5/1989 | Takasaki |
| 4,844,651 | A | 7/1989 | Partridge |
| 4,925,141 | A | 5/1990 | Classen |
| 5,015,134 | A | 5/1991 | Gotoh |
| 5,064,324 | A | 11/1991 | Ragaller |
| 5,083,483 | A | 1/1992 | Takagi |
| 5,207,085 | A | 5/1993 | Hopkins et al. |
| 5,271,670 | A | 12/1993 | Grabher |
| 5,282,708 | A | 2/1994 | Giannuzzi |
| 5,322,396 | A | 6/1994 | Blacker |
| 5,341,706 | A | 8/1994 | Takagi |
| 5,394,667 | A | 3/1995 | Nystrom |
| 5,407,313 | A | 4/1995 | Bruins et al. |
| 5,452,630 | A | 9/1995 | Haas et al. |
| 5,469,767 | A | 11/1995 | Habermehl |
| 5,529,451 | A | 6/1996 | Bruins et al. |
| 5,531,142 | A | 7/1996 | Adamo |
| 5,568,753 | A | 10/1996 | Habermehl et al. |
| 5,570,618 | A | 11/1996 | Habermehl et al. |
| 5,687,624 | A | 11/1997 | Tsuge et al. |
| D391,135 | S | 2/1998 | Habermehl et al. |
| 5,728,330 | A | 3/1998 | Erwin et al. |
| 5,839,332 | A | 11/1998 | Fujiyama et al. |
| 5,842,319 | A | 12/1998 | Ravetto |
| 5,871,486 | A | 2/1999 | Huebner et al. |
| 5,904,079 | A | 5/1999 | Tsuge et al. |
| 5,918,512 | A | 7/1999 | Habermehl et al. |
| 5,927,163 | A | 7/1999 | Habermehl et al. |
| 5,988,025 | A | 11/1999 | Sasaki et al. |
| 5,997,209 | A | 12/1999 | Sachs |
| 6,027,004 | A | 2/2000 | Ramella et al. |
| 6,036,398 | A | 3/2000 | Theodorou |
| D427,050 | S | 6/2000 | Bryan |
| 6,098,442 | A | 8/2000 | Walldorf et al. |
| 6,109,144 | A | 8/2000 | Muro |
| 6,109,146 | A | 8/2000 | Muro |
| 6,230,385 | B1 | 5/2001 | Nelson |
| 6,296,433 | B1 | 10/2001 | Forsell et al. |
| D450,568 | S | 11/2001 | Sachs |
| 6,314,699 | B1 | 11/2001 | West |
| 6,322,307 | B1 | 11/2001 | Glover |
| 6,328,516 | B1 | 12/2001 | Hettich |
| 6,345,940 | B2 | 2/2002 | Anjanappa et al. |
| 6,394,712 | B1 | 5/2002 | Weinstein et al. |
| 6,416,269 | B1 | 7/2002 | Martel et al. |
| 6,418,681 | B1 | 7/2002 | Dunks |
| 6,418,693 | B2 | 7/2002 | Ballard |
| 6,425,306 | B1 | 7/2002 | Habermehl |
| 6,439,085 | B1 | 8/2002 | Habermehl et al. |
| 6,470,641 | B1 | 10/2002 | Faure |
| 6,478,209 | B1 | 11/2002 | Bruins et al. |
| 6,484,467 | B2 | 11/2002 | Crout |
| 6,490,838 | B2 | 12/2002 | Summerford |
| D469,007 | S | 1/2003 | Chen et al. |
| 6,514,026 | B1 | 2/2003 | Gerhard |
| 6,540,432 | B2 | 4/2003 | Albanese |
| 6,592,015 | B1 | 7/2003 | Gostylla et al. |
| 6,594,961 | B2 | 7/2003 | Leines |
| 6,601,480 | B1 | 8/2003 | Habermehl |
| 6,604,901 | B1 | 8/2003 | Grossberndt et al. |
| 6,623,228 | B1 | 9/2003 | Hettich et al. |
| 6,647,638 | B1 | 11/2003 | Doyal |
| 6,651,398 | B2 | 11/2003 | Gregori |
| 6,651,400 | B1 | 11/2003 | Murphy |
| 6,711,864 | B2 | 3/2004 | Erwin |
| D488,373 | S | 4/2004 | Eberle |
| 6,726,411 | B2 | 4/2004 | Sommerfeld et al. |
| 6,736,303 | B2 | 5/2004 | Bruins et al. |
| 6,769,332 | B2 | 8/2004 | Muro |
| 6,779,700 | B2 | 8/2004 | Bruins et al. |
| 6,810,633 | B2 | 11/2004 | Harris |
| 6,843,402 | B2 | 1/2005 | Sims et al. |
| 6,887,023 | B1 | 5/2005 | Lu et al. |
| 6,915,724 | B2 | 7/2005 | Kigel et al. |
| 6,941,847 | B2 | 9/2005 | Habermehl et al. |
| 6,968,945 | B2 | 11/2005 | Bruins et al. |
| 6,993,875 | B2 | 2/2006 | Rudduck |
| 7,037,059 | B2 | 5/2006 | Dicke |
| 7,044,460 | B2 | 5/2006 | Bolton |
| 7,052,200 | B2 | 5/2006 | Harris |
| 7,073,303 | B2 | 7/2006 | Baker |
| 7,090,453 | B2 | 8/2006 | Lin |
| 7,156,600 | B2 | 1/2007 | Panasik et al. |
| 7,165,481 | B2 | 1/2007 | Kikuchi |
| 7,168,213 | B2 | 1/2007 | Rudduck et al. |
| 7,207,095 | B2 | 4/2007 | Bruins et al. |
| 7,231,854 | B2 | 6/2007 | Kikuchi |

(56) References Cited

U.S. PATENT DOCUMENTS

D547,169 S 7/2007 Harris
D557,131 S 12/2007 Liu
7,341,146 B2 3/2008 Habermehl
7,344,057 B2 3/2008 Dion et al.
7,344,058 B2 3/2008 Bruins et al.
D567,075 S 4/2008 Kashikura et al.
D567,644 S 4/2008 Liu
D573,454 S 7/2008 Eberle, III
7,398,623 B2 7/2008 Martel et al.
7,419,717 B2 9/2008 Chen et al.
7,424,840 B1 9/2008 Huang
7,444,792 B2 11/2008 Matson
7,454,996 B2 11/2008 Hsu
D581,776 S 12/2008 Yin-Feng
7,481,346 B2 1/2009 Vandenberg et al.
7,530,483 B2 5/2009 Bruins et al.
7,533,500 B2 5/2009 Morton et al.
7,546,717 B2 6/2009 Juan Puerta
7,578,105 B2 8/2009 Eberle, III
7,600,353 B2 10/2009 Hafner
D604,153 S 11/2009 Wantz
D604,599 S 11/2009 Prichard, Jr. et al.
7,628,305 B2 12/2009 Vanden Berg et al.
7,661,340 B2 2/2010 Xu
7,682,118 B2 3/2010 Gong et al.
7,682,119 B2 3/2010 Chen
7,695,228 B2 4/2010 Craven
D614,942 S 5/2010 Gaudron
7,779,765 B2 8/2010 Donnell, Jr. et al.
7,805,902 B2 10/2010 Martel
7,836,970 B2 11/2010 Bruins et al.
7,861,482 B2 1/2011 Pervan et al.
7,866,236 B2 1/2011 Hsu
7,882,994 B2 2/2011 Francescon
RE42,207 E 3/2011 Janusz
D634,186 S 3/2011 Kemper
7,908,816 B2 3/2011 Grafenauer et al.
D637,071 S 5/2011 Gaudron et al.
D637,896 S 5/2011 Dotsey
7,950,312 B2 5/2011 Matthiesen et al.
7,984,599 B2 7/2011 Snell et al.
7,992,469 B2 8/2011 Chang et al.
D647,393 S 10/2011 Carrillo, Sr. et al.
8,162,196 B2 4/2012 Gasser et al.
8,192,124 B2 6/2012 Wolpert et al.
D662,808 S 7/2012 Vandenberg
D664,836 S 8/2012 Kikuchi
8,234,830 B2 8/2012 Pervan et al.
8,336,272 B2 12/2012 Prager et al.
8,348,571 B2 1/2013 Shih
8,356,534 B2 1/2013 Hale et al.
8,360,702 B2 1/2013 Yu
8,382,414 B2 2/2013 Vandenberg
D677,147 S 3/2013 Vandenberg
8,393,125 B2 3/2013 Martel
8,480,343 B2 7/2013 Vandenberg
8,517,238 B2 8/2013 Gensmann et al.
D693,210 S 11/2013 Vandenberg
8,635,933 B2 1/2014 Hale
8,672,204 B2 3/2014 Vandenberg
8,677,868 B2 3/2014 Hoffman et al.
D704,018 S 5/2014 Vandenberg
8,740,531 B2 6/2014 Su et al.
8,747,043 B2 6/2014 Vandenberg
8,769,905 B2 7/2014 Pervan et al.
8,820,198 B2 9/2014 Park
8,847,113 B2 9/2014 Unrath et al.
8,891,825 B2 11/2014 Baele et al.
8,925,274 B2 1/2015 Darko et al.
8,925,644 B2 1/2015 Vandenberg
8,955,210 B2 2/2015 Vandenberg
8,985,888 B2 3/2015 Kawasaki
9,051,726 B2 6/2015 Vandenberg
9,120,214 B2 9/2015 Vandenberg
9,121,181 B2 9/2015 Hamberger
9,144,896 B2 9/2015 Vandenberg
D742,730 S 11/2015 Vandenberg
9,181,715 B2 11/2015 Orchard
D745,368 S 12/2015 Ltze
9,212,493 B2 12/2015 Cappelle et al.
9,222,269 B2 12/2015 Bruins
9,260,870 B2 2/2016 Vermeulen et al.
9,347,469 B2 5/2016 Pervan et al.
9,376,821 B2 6/2016 Pervan et al.
9,422,728 B2 8/2016 Gamble et al.
9,428,919 B2 8/2016 Pervan et al.
9,453,347 B2 9/2016 Pervan
9,464,443 B2 10/2016 Martensson
9,476,208 B2 10/2016 Vermeulen et al.
9,714,673 B2 7/2017 Phillips
9,751,197 B2 9/2017 Vandenberg
9,771,723 B2 9/2017 Pervan
9,784,296 B2 10/2017 Vandenberg
9,802,300 B2 10/2017 Vandenberg
9,868,147 B2 1/2018 Wadsworth
9,874,032 B1 1/2018 Chen
9,932,744 B2 4/2018 Vandenberg
9,963,886 B2 5/2018 Mitchell
9,976,312 B2 5/2018 Boschian
D842,086 S 3/2019 Vandenberg
10,220,497 B2 3/2019 Vandenberg
10,240,349 B2 3/2019 Pervan et al.
10,246,883 B2 4/2019 Derelov
D850,897 S 6/2019 Vandenberg
D850,898 S 6/2019 Vandenberg
10,309,099 B2 6/2019 Brigham et al.
10,315,295 B2 6/2019 Vandenberg
D853,829 S 7/2019 Vandenberg
10,378,217 B2 8/2019 Pervan
10,378,218 B2 8/2019 Vandenberg
10,407,898 B2 9/2019 Tebo
10,414,030 B2 9/2019 Vandenberg
10,421,176 B2 9/2019 Vandenberg
10,486,399 B2 11/2019 Chen et al.
10,494,821 B2 12/2019 Shadwell et al.
10,576,612 B2 3/2020 Vandenberg
10,590,978 B2 3/2020 Shadwell
D883,765 S 5/2020 Vandenberg
D888,544 S 6/2020 Vandenberg
10,794,065 B2 10/2020 Boo et al.
10,850,373 B2 12/2020 Vandenberg
10,895,080 B1 1/2021 Mackenzie
10,914,075 B2 2/2021 Vandenberg et al.
10,960,525 B2 3/2021 Vandenberg
10,961,719 B2 3/2021 Doupe et al.
10,968,639 B2 4/2021 Pervan et al.
D924,044 S * 7/2021 Vandenberg ..... D8/382
11,053,692 B2 7/2021 Pervan
11,078,673 B2 8/2021 Pervan et al.
11,111,679 B2 9/2021 Vandenberg et al.
11,149,445 B2 * 10/2021 Vandenberg ..... F16B 5/002
D945,870 S * 3/2022 Vandenberg ..... D8/382
11,261,893 B2 * 3/2022 Vandenberg ..... F16B 12/2063
11,305,407 B2 4/2022 Vandenberg
11,408,181 B2 8/2022 Pervan
11,575,344 B2 2/2023 Braunstein et al.
11,603,670 B2 3/2023 Vandenberg et al.
11,667,023 B2 6/2023 Vandenberg
11,674,319 B2 6/2023 Pervan et al.
11,674,544 B2 6/2023 Colyn et al.
11,680,415 B2 6/2023 Pervan et al.
11,702,847 B2 7/2023 Bergelin et al.
D996,962 S 8/2023 Schwartzkopf et al.
11,725,394 B2 8/2023 Pervan
11,731,252 B2 8/2023 Schwartzkopf et al.
11,781,577 B2 10/2023 Hkansson et al.
11,788,568 B2 10/2023 Maertens et al.
11,795,701 B2 10/2023 Whispell et al.
11,839,958 B2 12/2023 Vandenberg
11,840,848 B2 12/2023 Vandenberg et al.
11,898,357 B2 2/2024 Vandenberg et al.
D1,019,365 S 3/2024 Vandenberg et al.
11,920,618 B2 3/2024 Vandenberg et al.
11,933,055 B2 3/2024 Cappelle

(56) References Cited

U.S. PATENT DOCUMENTS

| | | | | |
|---|---|---|---|---|
| 11,938,596 | B1 | 3/2024 | Vandenberg et al. | |
| D1,022,684 | S | 4/2024 | Schwartzkopf et al. | |
| 11,969,863 | B2 | 4/2024 | Schwartzkopf et al. | |
| D1,026,605 | S | 5/2024 | Lecompte et al. | |
| D1,026,636 | S | 5/2024 | Lecompte et al. | |
| 11,987,990 | B2 | 5/2024 | Pervan et al. | |
| 11,999,032 | B2 | 6/2024 | Schwartzkopf | |
| D1,035,431 | S | 7/2024 | Lecompte et al. | |
| 2001/0030138 | A1 | 10/2001 | Bruins et al. | |
| 2003/0057248 | A1 | 3/2003 | Bruins et al. | |
| 2003/0121226 | A1 | 7/2003 | Bolduc | |
| 2003/0154662 | A1 | 8/2003 | Bruchu et al. | |
| 2003/0213829 | A1 | 11/2003 | Bruins et al. | |
| 2003/0235483 | A1 | 12/2003 | Chen | |
| 2004/0237460 | A1 | 12/2004 | Green | |
| 2005/0000835 | A1 | 1/2005 | Bruins et al. | |
| 2005/0257473 | A1 | 11/2005 | Shaw et al. | |
| 2005/0265807 | A1 | 12/2005 | Bruins et al. | |
| 2005/0278934 | A1 | 12/2005 | Orchard | |
| 2006/0059822 | A1* | 3/2006 | Guffey | F16B 12/125 52/480 |
| 2006/0179757 | A1 | 8/2006 | Schulner | |
| 2006/0242916 | A1 | 11/2006 | Simko et al. | |
| 2006/0283122 | A1 | 12/2006 | Burgess et al. | |
| 2006/0289597 | A1 | 12/2006 | Bruins et al. | |
| 2007/0128001 | A1 | 6/2007 | Su | |
| 2007/0164076 | A1 | 7/2007 | Vandenberg et al. | |
| 2007/0289249 | A1 | 12/2007 | Martel | |
| 2007/0290022 | A1 | 12/2007 | Bruins et al. | |
| 2008/0025816 | A1 | 1/2008 | Chen et al. | |
| 2008/0080951 | A1 | 4/2008 | Lin | |
| 2008/0093412 | A1 | 4/2008 | Vandenberg et al. | |
| 2008/0264218 | A1 | 10/2008 | Wang et al. | |
| 2008/0279654 | A1 | 11/2008 | Deschamps | |
| 2009/0010734 | A1 | 1/2009 | Lin | |
| 2009/0019805 | A1 | 1/2009 | Zanelli | |
| 2009/0108719 | A1 | 4/2009 | Lilly | |
| 2009/0184149 | A1 | 7/2009 | Bruins et al. | |
| 2009/0217495 | A1 | 9/2009 | Tipps et al. | |
| 2009/0249730 | A1 | 10/2009 | Vibiano | |
| 2009/0314143 | A1 | 12/2009 | Chen | |
| 2010/0050556 | A1 | 3/2010 | Burns | |
| 2010/0083610 | A1 | 4/2010 | King | |
| 2010/0107524 | A1 | 5/2010 | Moss | |
| 2010/0257806 | A1* | 10/2010 | Snell | F16B 5/0072 52/705 |
| 2011/0167757 | A1 | 7/2011 | Vandenberg | |
| 2011/0170984 | A1 | 7/2011 | Vandenberg | |
| 2011/0170985 | A1 | 7/2011 | Vandenberg | |
| 2012/0204409 | A1 | 8/2012 | Vandenberg | |
| 2013/0025230 | A1 | 1/2013 | Turner | |
| 2013/0087023 | A1 | 4/2013 | Vandenberg | |
| 2013/0219690 | A1 | 8/2013 | Vandenberg | |
| 2013/0266398 | A1 | 10/2013 | Vandenberg | |
| 2013/0276589 | A1 | 10/2013 | Vandenberg | |
| 2013/0276591 | A1 | 10/2013 | Vandenberg | |
| 2013/0291860 | A1 | 11/2013 | Krishnamoorthy et al. | |
| 2013/0340377 | A1 | 12/2013 | Shadwell | |
| 2014/0137509 | A1 | 5/2014 | Vandenberg | |
| 2014/0305064 | A1 | 10/2014 | Baker et al. | |
| 2015/0135913 | A1 | 5/2015 | Vandenberg | |
| 2015/0167721 | A1 | 6/2015 | Vandenberg | |
| 2015/0176290 | A1 | 6/2015 | Bruins | |
| 2015/0211558 | A1 | 7/2015 | Garrison | |
| 2015/0321325 | A1 | 11/2015 | Vandenberg | |
| 2015/0345156 | A1 | 12/2015 | Vandenberg | |
| 2015/0354204 | A1 | 12/2015 | Kinnunen et al. | |
| 2017/0239794 | A1 | 8/2017 | Vandenberg | |
| 2017/0239795 | A1 | 8/2017 | Vandenberg | |
| 2017/0241464 | A1 | 8/2017 | Vandenberg | |
| 2017/0314278 | A1 | 11/2017 | Lee et al. | |
| 2017/0320198 | A1 | 11/2017 | Vandenberg | |
| 2019/0055738 | A1 | 2/2019 | Vandenberg | |
| 2019/0055974 | A1 | 2/2019 | Vandenberg et al. | |
| 2019/0275648 | A1 | 9/2019 | Vandenberg | |
| 2019/0291248 | A1 | 9/2019 | Vandenberg | |
| 2019/0329385 | A1 | 10/2019 | Vandenberg | |
| 2019/0360214 | A1 | 11/2019 | Vandenberg et al. | |
| 2019/0381644 | A1 | 12/2019 | Vandenberg | |
| 2020/0087925 | A1* | 3/2020 | Vandenberg | F16B 5/0621 |
| 2020/0217077 | A1 | 7/2020 | Vandenberg et al. | |
| 2020/0362570 | A1 | 11/2020 | Vandenberg et al. | |
| 2021/0178562 | A1 | 6/2021 | Vandenberg | |
| 2021/0277668 | A1 | 9/2021 | Vandenberg et al. | |
| 2021/0301543 | A1 | 9/2021 | Carlson et al. | |
| 2021/0363761 | A1 | 11/2021 | Vandenberg et al. | |
| 2021/0404190 | A1* | 12/2021 | Vandenberg | E04F 15/02022 |
| 2022/0010825 | A1* | 1/2022 | Voß | E04F 13/10 |
| 2022/0136547 | A1 | 5/2022 | Vandenberg et al. | |
| 2022/0176525 | A1 | 6/2022 | Vandenberg | |
| 2022/0228373 | A1* | 7/2022 | Lail | E04F 15/02183 |
| 2022/0241937 | A1 | 8/2022 | Schwartzkopf et al. | |
| 2022/0333635 | A1 | 10/2022 | Colyn et al. | |
| 2023/0193638 | A1 | 6/2023 | Vandenberg et al. | |
| 2023/0258221 | A1 | 8/2023 | Colyn et al. | |
| 2023/0272624 | A1 | 8/2023 | Vandenberg et al. | |
| 2023/0304523 | A1 | 9/2023 | Vandenberg | |
| 2023/0347480 | A1 | 11/2023 | Schwartzkopf et al. | |
| 2023/0358057 | A1 | 11/2023 | Vandenberg et al. | |
| 2023/0383553 | A1 | 11/2023 | Schwartzkopf et al. | |
| 2023/0398666 | A1 | 12/2023 | Vandenberg | |
| 2024/0003140 | A1 | 1/2024 | Vandenberg et al. | |
| 2024/0042584 | A1 | 2/2024 | Schwartzkopf | |
| 2024/0133186 | A1 | 4/2024 | Vandenberg et al. | |
| 2024/0293921 | A1 | 9/2024 | Schwartzkopf | |

FOREIGN PATENT DOCUMENTS

| | | | |
|---|---|---|---|
| AU | 2007202763 | A1 | 1/2008 |
| AU | 2010251785 | A1 | 7/2011 |
| AU | 2010251791 | A1 | 7/2011 |
| AU | 2011213706 | B2 | 7/2013 |
| AU | 2013206456 | A1 | 1/2014 |
| AU | 2010251791 | B2 | 1/2015 |
| AU | 2010251785 | B2 | 10/2015 |
| AU | 2013206456 | B2 | 11/2015 |
| AU | 2017221342 | A1 | 8/2018 |
| AU | 201816229 | S | 12/2018 |
| AU | 201816246 | S | 12/2018 |
| AU | 2017221342 | B2 | 10/2019 |
| AU | 2019271912 | A1 | 12/2019 |
| AU | 2018317991 | A1 | 2/2020 |
| AU | 2018317991 | B2 | 3/2021 |
| AU | 2021203822 | A1 | 7/2021 |
| AU | 2021203822 | B2 | 4/2022 |
| CA | 2305852 | A1 | 10/2001 |
| CA | 2573867 | A1 | 7/2007 |
| CA | 2725335 | A1 | 7/2011 |
| CA | 2725340 | A1 | 7/2011 |
| CA | 2827504 | A1 | 7/2011 |
| CA | 2820655 | A1 | 12/2013 |
| CA | 2573867 | C | 3/2014 |
| CA | 2725340 | C | 3/2014 |
| CA | 2725335 | C | 5/2014 |
| CA | 2820655 | C | 10/2015 |
| CA | 2827504 | C | 11/2015 |
| CA | 3013940 | A1 | 8/2017 |
| CA | 3071807 | A1 | 2/2019 |
| CA | 184454 | S | 11/2019 |
| CA | 184455 | S | 11/2019 |
| CA | 3013940 | C | 1/2021 |
| CA | 3071807 | C | 11/2021 |
| CA | 200935 | S | 7/2022 |
| CN | 107762098 | A | 3/2018 |
| DE | 1911208 | A1 | 9/1969 |
| DE | 4228727 | A1 | 3/1994 |
| DE | 20002567 | U1 | 8/2001 |
| DE | 102008008074 | A1 | 7/2009 |
| DE | 202010009449 | U1 | 9/2010 |
| DE | 202011005177 | U1 | 7/2011 |
| DE | 202014004575 | U1 | 8/2014 |
| DE | 202014006016 | U1 | 10/2014 |
| DE | 102014011022 | A1 | 1/2016 |
| DE | 202018003385 | U1 | 10/2018 |

(56) References Cited

FOREIGN PATENT DOCUMENTS

| | | | | |
|---|---|---|---|---|
| DE | 102018005758 | A1 * | 1/2020 | ..... E04F 15/02044 |
| EP | 482363 | A1 | 4/1992 | |
| EP | 863317 | A2 | 9/1998 | |
| EP | 898656 | A1 | 3/1999 | |
| EP | 1595627 | B1 | 4/2008 | |
| EP | 1932623 | A1 | 6/2008 | |
| EP | 2076362 | B1 | 3/2012 | |
| EP | 2444678 | A1 | 4/2012 | |
| EP | 2476819 | A1 | 7/2012 | |
| EP | 2489812 | A1 | 8/2012 | |
| EP | 2517834 | A2 | 10/2012 | |
| EP | 2397706 | B1 | 11/2012 | |
| EP | 1920890 | B1 | 1/2014 | |
| EP | 1938928 | B1 | 4/2014 | |
| EP | 2517834 | A3 | 3/2015 | |
| EP | 2995744 | B1 | 3/2017 | |
| EP | 2228504 | B1 | 5/2017 | |
| EP | 2845965 | B1 | 6/2017 | |
| EP | 3150083 | B1 | 11/2017 | |
| EP | 2517834 | B1 | 1/2018 | |
| EP | 3416782 | A2 | 12/2018 | |
| EP | 2258518 | B1 | 8/2019 | |
| EP | 3669036 | A1 | 6/2020 | |
| EP | 3892795 | A1 | 10/2021 | |
| EP | 3669036 | B1 | 3/2023 | |
| EP | 3892795 | B1 | 8/2023 | |
| EP | 4242397 | A2 | 9/2023 | |
| EP | 4242397 | A3 | 9/2023 | |
| EP | 3416782 | B1 | 11/2023 | |
| EP | 4242397 | B1 | 4/2024 | |
| FR | 1271428 | A | 9/1961 | |
| FR | 2857041 | B1 | 5/2007 | |
| FR | 2968366 | A1 | 6/2012 | |
| FR | 2995744 | A1 | 3/2014 | |
| GB | 191001226 | A | 12/1910 | |
| GB | 167620 | A | 8/1921 | |
| GB | 1009630 | A | 11/1965 | |
| GB | 1224840 | A | 3/1971 | |
| GB | 1260093 | A | 1/1972 | |
| GB | 2127927 | A | 4/1984 | |
| GB | 2542898 | A | 4/2017 | |
| JP | 07217625 | A | 8/1995 | |
| JP | 25060421 | B2 | 12/1996 | |
| JP | 2560421 | Y2 | 1/1998 | |
| JP | 10329049 | A | 12/1998 | |
| JP | 2000257616 | A | 9/2000 | |
| JP | 2004308732 | A | 11/2004 | |
| JP | 2011236601 | A | 11/2011 | |
| JP | 4908098 | B2 | 4/2012 | |
| JP | 2016061061 | A | 4/2016 | |
| JP | 2018529530 | A | 10/2018 | |
| JP | 1650619 | S | 1/2020 | |
| JP | 1650620 | S | 1/2020 | |
| JP | 6761023 | B2 | 9/2020 | |
| KR | 1020080083788 | A | 9/2008 | |
| KR | 1020080088160 | A | 10/2008 | |
| KR | 1020100120935 | A | 11/2010 | |
| KR | 101229895 | B1 | 1/2013 | |
| KR | 2020130000374 | U | 1/2013 | |
| KR | 101263988 | B1 | 5/2013 | |
| KR | 2020140001877 | U | 4/2014 | |
| KR | 101455585 | B1 | 10/2014 | |
| KR | 101579965 | B1 | 12/2015 | |
| KR | 101781610 | B1 | 9/2017 | |
| KR | 102095981 | B1 | 4/2020 | |
| KR | 10-2176238 | B1 | 11/2020 | |
| KR | 102180567 | B1 | 11/2020 | |
| KR | 10-2337642 | B1 | 12/2021 | |
| MY | 166977 | A | 7/2018 | |
| TH | 116786 | A1 | 10/2012 | |
| TW | 201142157 | A | 12/2011 | |
| TW | I361861 | B | 4/2012 | |
| TW | M441693 | U | 11/2012 | |
| TW | 201729954 | A | 9/2017 | |
| TW | 632991 | B | 8/2018 | |
| TW | 201910653 | A | 3/2019 | |
| TW | D200169 | S | 10/2019 | |
| TW | D200170 | S | 10/2019 | |
| TW | 679332 | B | 12/2019 | |
| TW | I679332 | B | 12/2019 | |
| TW | D230352 | S | 3/2024 | |
| VN | 29624 | A1 | 5/2012 | |
| WO | 199717505 | A1 | 5/1997 | |
| WO | 199939878 | A1 | 8/1999 | |
| WO | 2007091487 | A1 | 8/2007 | |
| WO | 2009145367 | A1 | 12/2009 | |
| WO | 2011/159195 | A1 | 12/2011 | |
| WO | 2017142979 | A2 | 8/2017 | |
| WO | 2017142979 | A3 | 10/2017 | |
| WO | 2017142979 | A4 | 12/2017 | |
| WO | 2019036146 | A1 | 2/2019 | |
| WO | 2019173007 | A1 | 9/2019 | |

OTHER PUBLICATIONS

Deck Fastener, Instructions TCG, http://web.archive.org/web/20100612222944/http://www.deckfastener.com/pdfs/Instructions_TCG.pdf, Jun. 12, 2010, Accessed Sep. 4, 2024.

Fastenmaster, ProClip PVC Decking Hidden Fastener, https://web.archive.org/web/20140125202024/http://www.fastenmaster.com/details/product/proclip-pvc-decking-hidden-fastener.html. Jan. 25, 2014, Accessed Sep. 4, 2024.

Fastenmaster, TC-120 Grooved Board Hidden Deck Fastener for Hardwood, https://web.archive.org/web/20140125201918/http://www.fastenmaster.com/details/product/tc-120-grooved-board-hidden-deck-fastener-for-hardwood.html, Jan. 25, 2014, Accessed Sep. 4, 2024.

Camo Fasteners, Hidden Clips, https://web.archive.org/web/20150207013153/http://www.camofasteners.com/hidden-clips/, Feb. 7, 2015, Accessed Sep. 4, 2024.

Trex, Elevations Installation Guide, https://web.archive.org/web/20150404075843/http://s7d4.scene7.com/is/content/Trex/trex-elevations-installation-guidepdf.pdf, Apr. 4, 2015, Accessed Sep. 4, 2024.

Eurotec, Gesamtkatalog, https://www.eurotec.team/application/files/1116/7509/2615/Gesamtkatalog_EN.pdf, Oct. 29, 2016, Accessed Sep. 4, 2024.

Eurotec, Systemclip ECO, https://web.archive.org/web/20160909054047/http://www.e-u-r-o-tec.de/de/produkt/view/5688386085978112/Systemclip%2BECO, Sep. 9, 2016, Accessed Sep. 4, 2024.

Ipe Clip, Hidden Hardwood Siding Clips, https://web.archive.org/web/20161023021846/https://www.ipeclip.com/hidden-hardwood-siding-clips, Oct. 23, 2016, Accessed Sep. 4, 2024.

Sure Drive, Hidden Deck Fasteners, https://web.archive.org/web/20160326211712/http://suredrive.com/products/BROWSE_BRAND/SURE_DRIVE/HIDDEN_DECK_FASTENERS.aspx, Mar. 26, 2016, Accessed Sep. 4, 2024.

Sure Drive, Mantis Hidden Deck Fasteners, https://web.archive.org/web/20160608100039/http://www.suredrive.com/products/BROWSE_BRAND/SURE_DRIVE/HIDDEN_DECK_FASTENERS/MANTIS_HIDDEN_DECK_FASTENERS.aspx, Jun. 8, 2016, Accessed Sep. 4, 2024.

Trex, Accessory Hardware, https://web.archive.org/web/20160403194909/http://www.trex.com/products/accessory-hardware, Apr. 3, 2016, Accessed Sep. 4, 2024.

Fastenmaster, TC-4S Hardwood IPE Hidden Deck Fastener, https://web.archive.org/web/20170615025536/http://www.fastenmaster.com/products/tigerclaw-hidden-fastening/tc-4s-hardwood-ipe-hidden-deck-fastener.html, Jun. 15, 2017, Accessed Sep. 4, 2024.

Invisi-Fast, Hidden Deck Fasteners, https://web.archive.org/web/20170722054255/https:/invisifast.com, Jul. 22, 2017, Accessed Sep. 4, 2024.

Trex, Accessory Hardware, https://web.archive.org/web/20170606202141/http://www.trex.com/products/accessory-hardware, Jun. 6, 2017, Accessed Sep. 4, 2024.

(56) References Cited

OTHER PUBLICATIONS

Newtechwood, Decking Clips, https://web.archive.org/web/20181222193159/http://newtechwood.com/decking-clips.html, Dec. 22, 2018, Accessed Sep. 4, 2024.
Camo Fasteners, Camo Starter Clips for Grooved Decking, https://www.youtube.com/watch?v=CFSBYXuBMVU, Aug. 26, 2019, Accessed Sep. 5, 2024.
Camo Fasteners, How to Install a Camo Edge Clip, https://www.youtube.com/watch?v=3-A_P8kyPxo, Feb. 14, 2019, Accessed Sep. 5, 2024.
Camo Fasteners, How to Install a Camo Edge Clip, https://www.youtube.com/watch?v=OZrrwROtAvU, Feb. 14, 2019, Accessed Sep. 5, 2024.
Camo Fasteners, Edge Clips, https://web.archive.org/web/20200422115353/https://www.camofasteners.com/wp-content/uploads/edge-clips.png, Apr. 22, 2020, Accessed Sep. 11, 2024.
Camo Fasteners, Edge X Clip, https://www.camofasteners.com/wp-content/uploads/Edge-x-clip.png, Apr. 22, 2020, Accessed Sep. 11, 2024.
Quadrofixing, Decking Clip Stainless Steel A2 Black Eurotec T-Clip, https://web.archive.org/web/20210924032304/https://quadrofixing.eu/decking-clip-stainless-steel-a2-black-eurotec-t-clip-175-pcs/p-97, Sep. 24, 2021, Accessed Sep. 4, 2024.
Quadrofixing, Decking Clip Stainless Steel A2 Eurotec V-Clip, https://web.archive.org/web/20210924024757/https://quadrofixing.eu/decking-clip-stainless-steel-a2-eurotec-v-clip-250-pcs/p-70, Sep. 24, 2021, Accessed Sep. 4, 2024.
Grip-Rite, Ninja Hidden Deck Clip, https://web.archive.org/web/20230603122329/https://grip-rite.com/product/ninja-hidden-deck-clip/, Jun. 3, 2023, Accessed Sep. 11, 2024.
Camo Fasteners, Edge Clips, https://www.camofasteners.com/products/clips/edge-clips/, Accessed Sep. 5, 2024.
Camo Fasteners, Edge X Clips, https://www.camofasteners.com/products/clips/edge-x-clips/, Accessed Sep. 5, 2024.
Camo Fasteners, Edge X Metal Copy, https://www.camofasteners.com/products/clips/edge-x-metal-copy/, Accessed Sep. 5, 2024.
Camo Fasteners, Edge X Metal, https://www.camofasteners.com/products/clips/edge-x-metal/, Accessed Sep. 5, 2024.
Camo Fasteners, How To Install Camo Wedgeclip and Wedgemetal Clips, https://www.youtube.com/watch?v=r1AyZJRdAz0, Mar. 7, 2024, Accessed Sep. 5, 2024.
Camo Fasteners, How to Install New Camo Wedge and Wedgemetal Clips, https://www.youtube.com/watch?v=rxSGRMYGb0w, Mar. 6, 2024, Accessed Sep. 5, 2024.
Camo Fasteners, Starter Clips, https://www.camofasteners.com/products/clips/starter-clips/, Accessed Sep. 5, 2024.
Camo Fasteners, Wedge Clips, https://www.camofasteners.com/products/clips/wedge-clips/, Accessed Sep. 5, 2024.
Camo Fasteners, Wedge Clips, https://www.camofasteners.com/products/clips/wedge-clips/, Mar. 1, 2024, Accessed Sep. 11, 2024.
*National Nail Corporation* v. *Primesource Building Products*, Deposition of Roger Vanderberg, Case No. 3:23-CV-2746-K, US District Court for North District of Texas, Aug. 8, 2024, 280 pages.
Quadrofixing, Decking Clip Stainless Steel A2 Eurotec M-Clip, https://web.archive.org/web/20240222152742/https://quadrofixing.cz/terasovy-nerezovy-klip-eurotec-m-clip-200-ks-vruty/p-252, Feb. 22, 2024, Accessed Sep. 4, 2024.
Trex, "Composite Decking: Wood Alternative Decking Material: Trex," https://web.archive.org/web/20160329080407/http://www.trex.com/, Mar. 29, 2016, Accessed Sep. 4, 2024.
MetalsDepot, "A36 Structural Steel Channel," http://metalsdeport.com/products/hrsteel2.phtml?page=changgel&LimAcc=%20&aisdent=, Accessed Sep. 4, 2024.
Unistrut, "Unistrut 13/16" Metal Framing Strut Fittings," http://www.unistrutohio.com/unistrut-general-fittings-thirteeneth-sixteenth.inc/, Accessed Sep. 4, 2024.
The Ipe Clip Fastener Company, LLC. (n.d.), "Hidden Deck Fasteners Deck Building Ipe Clip," https://www.ipeclip.com/, Retrieved Nov. 18, 2024.
Parco, Inc. "Aluminum Strucutal Framing and Componets 1in, 1 1/2 in, 40 mm Profile," Catalog Rev. 2015-1, www.parco-inc.com.
IPE Clip Fasteners, Hidden Deck Fastener Installation Instructions, https://www.youtube.com/watch?v=ujU78uDwfg4, Oct. 6, 2009, Accessed Nov. 14, 2024.
DexSpan, Slide-and-Hide deck fasteners, https://www.youtube.com/watch?v=TISOPyIONiw, Jun. 19, 2015, Accesed Nov. 14, 2024.
IPE Clip, "Stainless Steel Rainscreen Side Clips, "https://www.ipeclip.com/hidden-hardwoord-siding-clips, Accessed Sep. 4, 2024.

* cited by examiner

DECK CLIP

CROSS-REFERENCE TO RELATED APPLICATIONS

The present application claims priority to U.S. patent application Ser. No. 17/974,755, titled DECK CLIP, filed Oct. 27, 2022, the entirety of which is hereby incorporated by reference.

BRIEF SUMMARY OF THE INVENTION

This disclosure generally relates to a deck clip. More particularly, the disclosure relates to an improved deck clip for quickly and securely attaching deck boards to joists without the use of exposed fasteners.

BACKGROUND OF THE INVENTION

A deck is a flat surface capable of supporting weight, similar to a floor, but typically constructed outdoors, often elevated from the ground, and usually connected to a house. The top of a deck is typically made up of deck boards that lay horizontal and span between joists. The deck boards may be made of wood, or a composite material such as a blend of wood and plastic.

Traditionally, deck boards are attached directly to the joists using fasteners, such as wood or metal screws. The screws in a traditional deck are orientated vertically and inserted through the top of the deck boards such that the heads of the screws are either flush with the top surface of the deck boards or sit slightly below the surface. However, because the screws remain visible, the screws may detract from an appearance of the deck.

Additionally, the screws can cause the deck boards to split during assembly or over time leading to accelerated degradation of the deck and an increased risk of splinters for the user.

Prior solutions to address these problems include using deck clips of various designs. Deck clips are brackets that couple deck boards to joists. Deck clips are typically affixed to joists using screws and are typically coupled to deck boards using a groove-and-groove system, where the deck clip may be inserted into to grooves on the sides of each board.

Alternatively, a tongue-and-groove system may be used, where the tongue portion contacts solely the bottom surface of the groove. Additionally, the traditional tongue-and-groove system is made up of smooth surfaces. Because the smooth surfaces offer limited friction and because of the relatively small contact area between the tongue and the groove, the typical deck clip system is a flawed method of coupling the deck boards to the joists.

The typical system does not offer a secure attachment method, and over time, the deck boards that are not securely attached can shift or become detached. This can lead to an unstable and unsafe deck which can be hazardous to the user.

Moreover, typical deck clip systems fit into the groove but are not held in place by anything other than the screw, meaning the clip must be inserted into the groove, and the screw must first be started into the joist before the next board can be put in place, with the screw being tightened down thereafter. If the screw is not started before the next board is put in place, the deck clip may get knocked off of the joist while aligning the next board. Thus, there is a need for a deck clip design without needing to contact the screws at least twice during installation, and to address some or all of the additional deficiencies.

Figure 1:
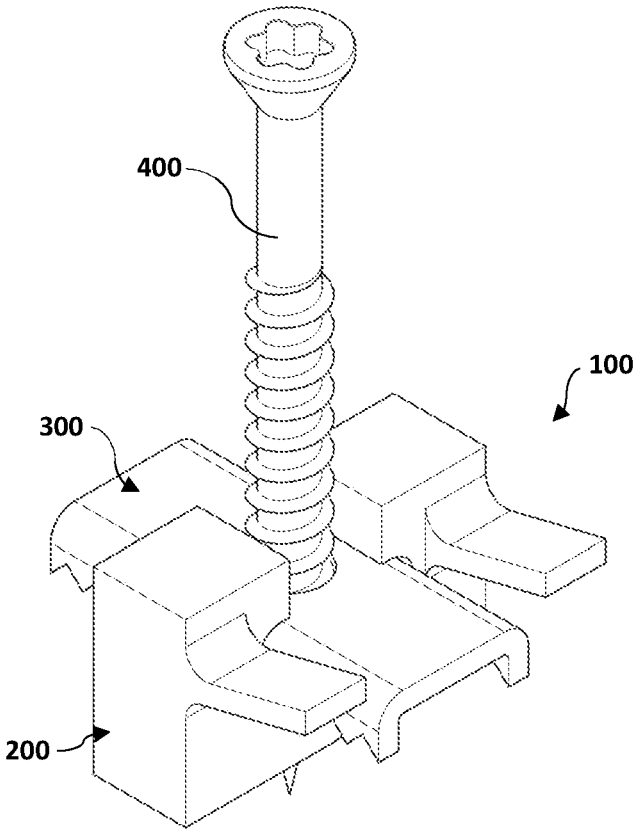
FIG. 1 illustrates a perspective view of a deck clip with a fastener according to an example embodiment.

Before explaining the disclosed embodiment of the present invention in detail, it is to be understood that the invention is not limited in its application to the details of the particular arrangement shown, since the invention is capable of other embodiments. Example embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

While this invention is susceptible of embodiments in many different forms, there are shown in the drawings and will be described in detail herein specific embodiments with the understanding that the present disclosure is an exemplification of the principles of the invention. It is not intended to limit the invention to the specific illustrated embodiments. The features of the invention disclosed herein in the description, drawings, and claims may be significant, both individually and in any desired combinations, for the operation of the invention in its various embodiments. Features from one embodiment may be used in other embodiments of the invention.

As shown in FIGS. 1-13, embodiments of this disclosure include a deck clip that can be used with a fastener.

Figure 2:
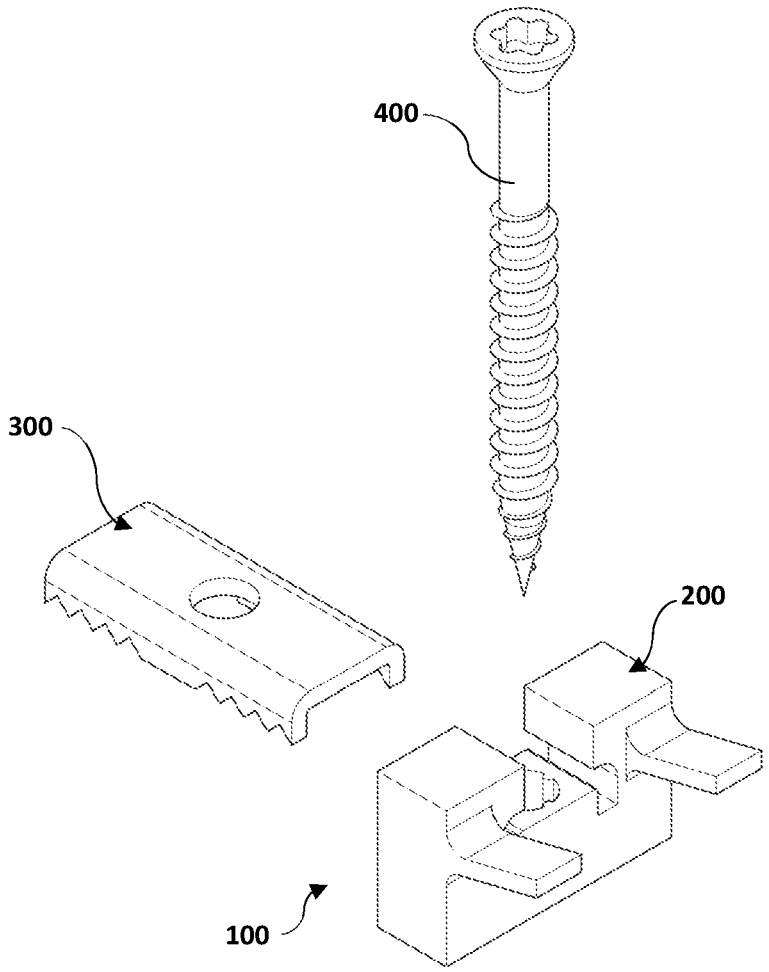
FIG. 2 illustrates an exploded view of the deck clip of FIG. 1 with a fastener.

Referring to FIGS. 1 and 2, a deck clip 100 according to an embodiment may include a spacer 200 and a grip 300. A fastener 400 may also be provided to fasten the grip 300 with the spacer 200.

Figure 3:
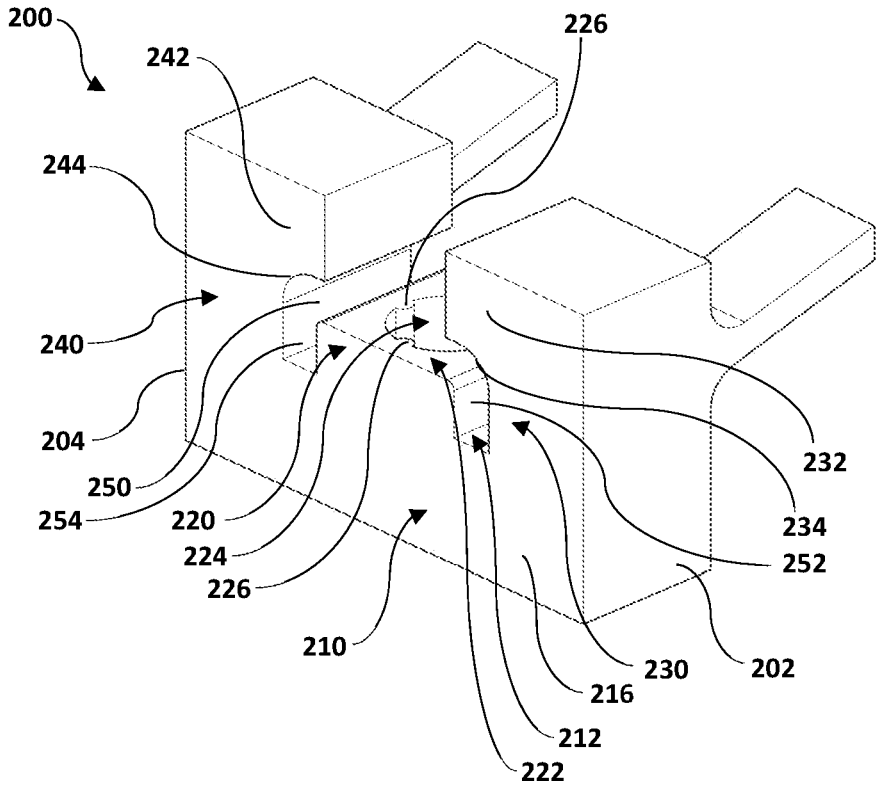
FIG. 3 illustrates a front perspective view of a spacer of the deck clip of FIG. 1.
Figure 4:
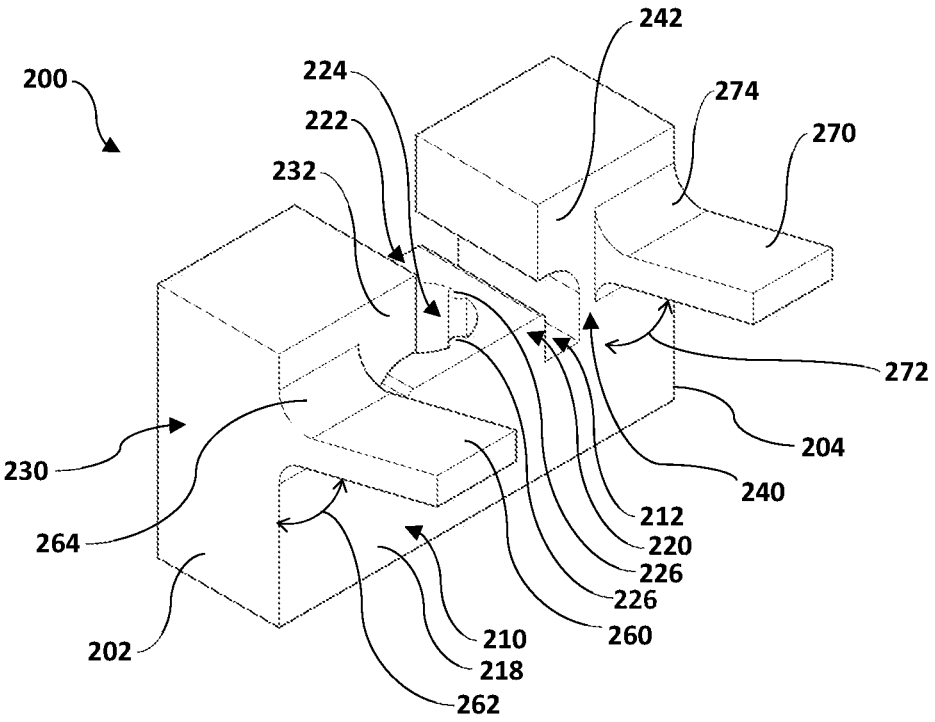
FIG. 4 illustrates a rear perspective view of the spacer of FIG. 3.

As illustrated in FIGS. 3 and 4, the spacer 200 may include a central member 210 that extends from a first end 202 to a second end 204. In some embodiments, the central member 210 may be substantially flat and rectangular in shape.

The central member 210 may include a top surface 212 and, opposite from and parallel to the top surface 212, a bottom surface 214 (see FIGS. 10-13). Additionally, the central member 210 may also include a front surface 216 (see FIG. 3) and a rear surface 218 (see FIG. 4) opposite from the front surface 216. The front surface 216 and the rear surface 218 may be perpendicular to the top surface 212 and the bottom surface 214.

In between the first end 202 and the second end 204, a protrusion 220 may be provided that protrudes upwardly and away from the top surface 212 of the central member 210. The protrusion 220 may include a upper surface 222 that is substantially parallel to the top surface 212 of the central member 210.

A first fastening hole 224 may be provided on the top surface 212. The first fastening hole 224 may be substantially circular in shape. The first fastening hole 224 may matches an outer profile of the fastener 400, thus permitting the fastener 400 to extend through the first fastening hole 224.

The first fastening hole 224 may extend from the upper surface 222 of the protrusion 220 down to the bottom surface 214 of the central member 210, thereby creates a bore through the entirety of the protrusion 220 and through the entirety of the central member 210.

A plurality of fastening nubs 226 may be provided in the first fastening hole 224. The fastening nubs 226 may be spaced radially along the circumference of the first fastening hole 224. In an embodiment, there may be four fastening nubs 226. In other embodiments, however, there may be more or less fastening nubs 226, or no fastening nubs 226 at all.

Further, at the first end 202, a first arm member 230 may be provided that protrudes upwardly and away from the top surface 212. Similarly, at the second end 204, a second arm member 240 may be provided that protrudes upwardly and away from the top surface 212. A first gap 252 may be provided between the protrusion 220 and the first arm member 230, and a second gap 254 may be provided between the protrusion 220 and the second arm member 240.

The first arm member 230 and the second arm member 240 may be substantially rectangular; however, other shapes are also foreseeable. Similarly, in the example embodiment, the first arm member 230 and the second arm member 240 are bound by the front surface 216 and the rear surface 218 of the central member 210; however, other configurations are also contemplated.

In addition, the first arm member 230 and the second arm member 240 may include a first cantilever member 232 and a second cantilever member 242 respectively. The first cantilever member 232 may protrude outwardly from the first arm member 230 towards the second end 204, and the second cantilever member 242 may protruding outwardly from the second arm member 240 towards the first end 202. The first cantilever member 232 and the second cantilever member 242 may be substantially rectangular; however, other shapes are also foreseeable.

In some embodiments, the first cantilever member 232 may substantially overlap the first gap 252 and the second cantilever member 242 may substantially overlap the second gap 254. More particularly, the first cantilever member 232 may have a first width that is substantially similar to a width of the first gap 252. Likewise, the second cantilever member 242 may have a second width that is substantially similar to a width of the second gap 254.

Referring now to FIG. 3, where the first cantilever member 232 joins the first arm member 230, a first corner 234 may be provided. The first corner 234 may be rounded, squared, or other suitable geometry. Similarly, where the second cantilever member 242 joins the second arm member 240, a second corner 244 may be provided. Likewise, the second corner 244 may be rounded, squared, or other suitable geometry.

A channel 250 may be formed in the spacer 200. More particularly, the channel 250 may be formed between the first arm member 230, the second arm member 240, the first cantilever member 232, the second cantilever member 242, and the protrusion 220. The channel 250 may match an outer profile of the grip 300 such that the grip 300 may slidingly engage the spacer 200.

Referring to FIG. 4, a first extension 260 may be provided that protrudes outwardly and away from the rear surface 218 of the first arm member 230. The first extension 260 may be flexible and may form a first angle 262 with the rear surface 218 of the central member 210.

Similarly, a second extension 270 may be provided that protrudes outwardly and away from the rear surface 218 of the second arm member 240 is illustrated. The second extension 270 may also be flexible form a similar, second angle 272 with the rear surface 218 of the central member 210.

Where the first extension 260 joins the first arm member 230 and where the second extension 270 joins the second arm member 240, there may be a first tapered portion 264 and a second tapered portion 274 respectively. The first tapered portion 264 and the second tapered portion 274 may be designed to bend in response to a downward shear force being applied to the first extension 260 and the second extension 270. For example, when no external forces are applied, the first angle 262 and the second angle 272 may each be between 90 degrees and 120 degrees. In some embodiments, when no external forces are applied, the first angle 262 and the second angle 272 may each be between 100 degrees and 110 degrees. More specifically, the first angle 262 and the second angle 272 may each be approximately 104 degrees.

However, when external forces are applied, the first tapered portion 264 and the second tapered portion 274 may bend such that the first angle 262 and the second angle 272 may decrease to 90 degrees or less. In order to prevent fractures resulting from bending, in the first tapered portion 264 and the second tapered portion 274, the cross-sectional area may be largest proximal to the rear surface 218, and the cross-sectional area may be smallest distal to the rear surface 218.

Figure 5:
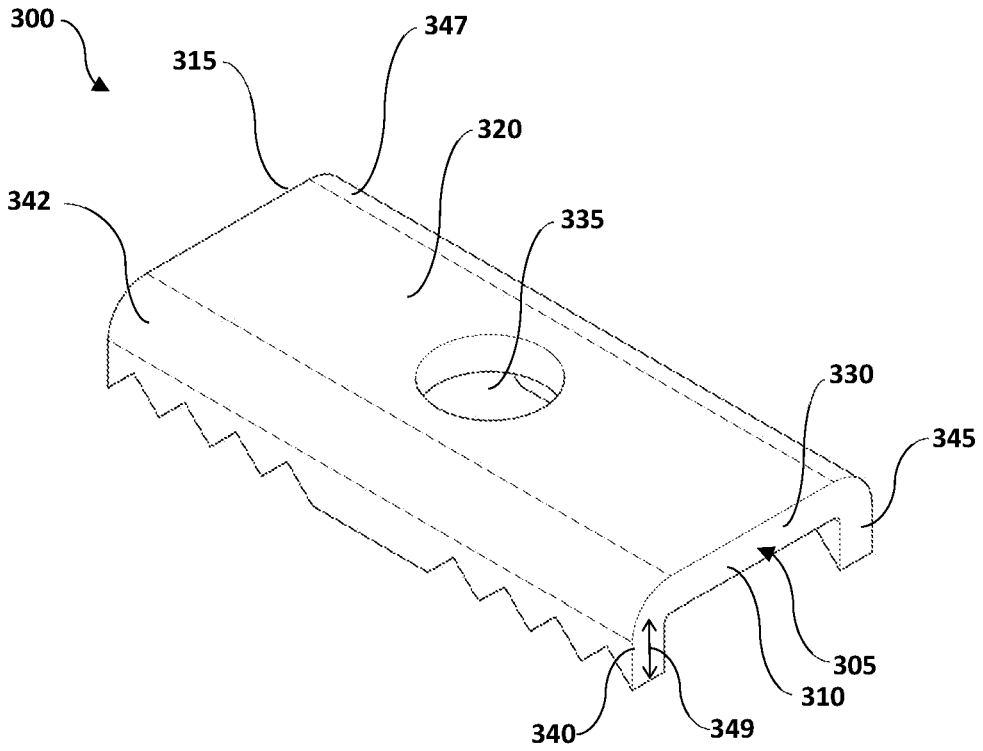
FIG. 5 illustrates a top perspective view of a grip of the deck clip of FIG. 1.

Referring now to FIG. 5, the grip 300 of the deck clip 100 is illustrated. The grip 300 may include a cross section 305 that extends from a first end 310 to a second end 315. The cross section 305 may be substantially C-shaped or U-shape. However, other shapes are contemplated. The cross section 305 of the grip 300 may be substantially similar to the channel 250 of the spacer 200. The cross section 305 may define an outer surface 320 of the grip 300. Additionally, parallel to and offset from the outer surface 320, an inner surface 325 may be provided (see FIG. 6).

The cross section 305 may include several distinct portions. First, a center portion 330 may be provided. A first leg portion 340 may be provided that is orthogonal and joined to the center portion 330. A second leg portion 345 may also be provided that is parallel to and offset from the first leg portion 340 and joined to the center portion 330. The center portion 330, the first leg portion 340, and the second leg portion 345 may each be substantially rectangular. The first leg portion 340 and the second leg portion 345 may both extend a length 349 down from the center portion 330 to their terminations.

In addition, the grip 300 may further include a first rounded edge 342 and a second rounded edge 347 where the center portion 330 joins the first leg portion 340 the second leg portion 345 respectively. The first rounded edge 342 and the second rounded edge 347 may have a curved profile that is substantially similar to the profile of the first corner 234 and the second corner 244 of the spacer 200.

A second fastening hole 335 may be provided through the center portion 330. The second fastening hole 335 may be substantially circular and it be located approximately equidistant from the first end 310 and the second end 315 of the grip 300. The second fastening hole 335 may also be positioned approximately equidistant from the first leg portion 340 and the second leg portion 345. In some embodiments, the second fastening hole 335 may also be countersunk or counterbored.

Figure 6:
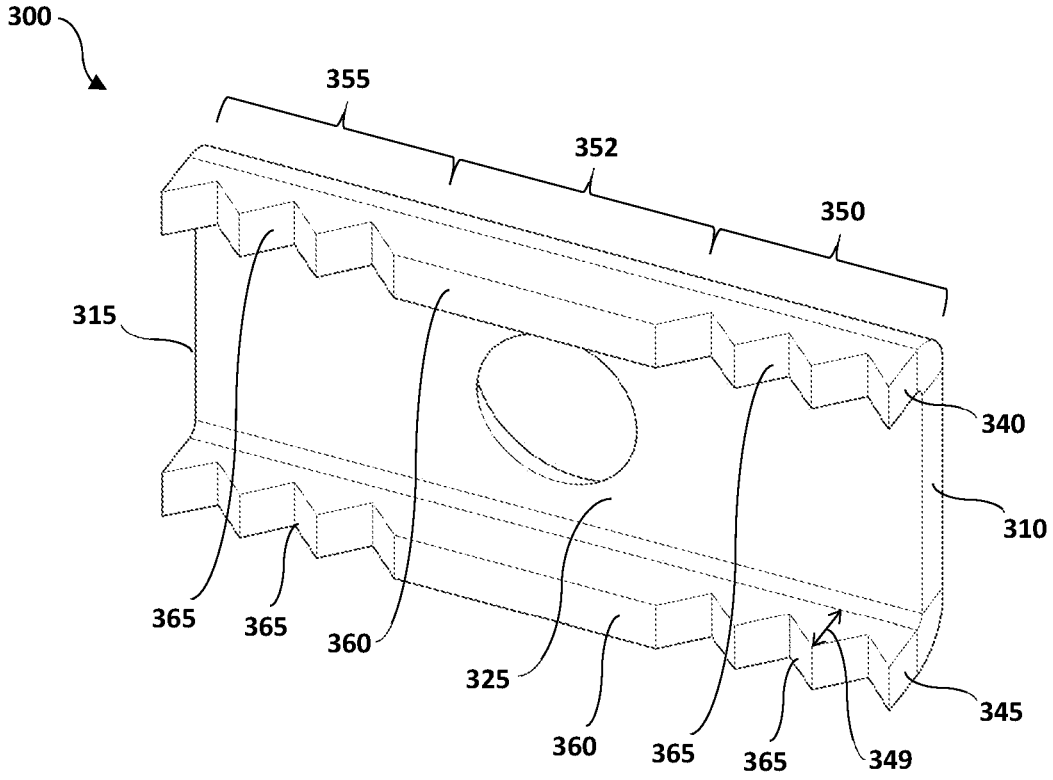
FIG. 6 illustrates a side perspective view of the grip of FIG. 5.

As best illustrated in FIG. 6, the grip 300 may include a first end region 350, a second end region 355, and a middle region 352. The first end region 350 may be proximal to the first end 310 of the grip 300; the second end region 355 may be proximal to the second end 315 of the grip 300; and the middle region 352 may be positioned between the first end region 350 and the second end region 355.

In the middle region 352 of the grip 300, the length 349 of the first leg portion 340 and the second leg portion 345 may be relatively constant. Thus, the first leg portion 340 and the second leg portion 345 may each have a mating surface 360 in the middle region 352. In some embodiments, the mating surface 360 may be substantially flat.

Conversely, in the first end region 350 and the second end region 355, the length 349 of the first leg portion 340 and the second leg portion 345 may vary substantially. Thus, in the first end region 350 and the second end region 355, the first leg portion 340 and the second leg portion 345 may each have grip surfaces 365 that may be irregularly shaped. More specifically, the grip surfaces 365 may be saw-tooth shaped surfaces having a plurality of peaks and a plurality of valleys or sinusoidal shaped surfaces; however, other shapes are contemplated.

In some embodiments, the channel 250 may be of a dimension such that when the grip 300 is inserted into the channel 250, a friction relative to the grip 300 can be applied on the grip 300. Such friction may prevent the grip 300 from moving in a vertical position toward or away from the first extension 260 or the second extension 270. In further embodiments, once the grip 300 is inserted into the channel 250, the first cantilever member 232 and the second cantilever member 242 may each abut a portion of the outer surface 320 of the grip 300, such that the grip 300 is prevented from moving in a vertical position toward or away from the first extension 260 or the second extension 270.

Figure 7:
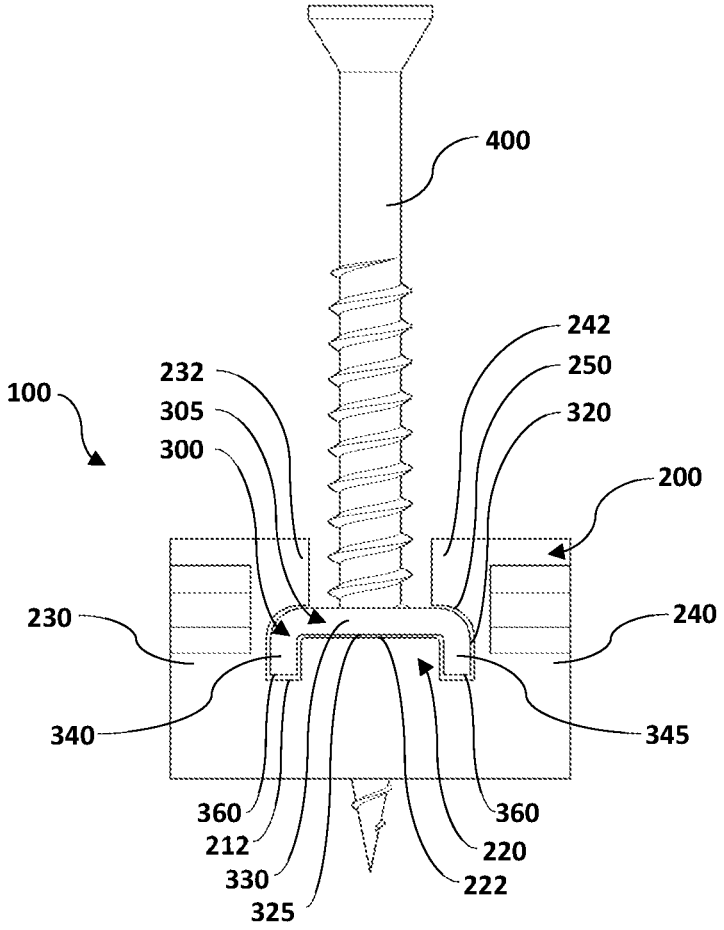
FIG. 7 illustrates a side view of the deck clip of FIG. 1 together with a fastener.
Figure 8:
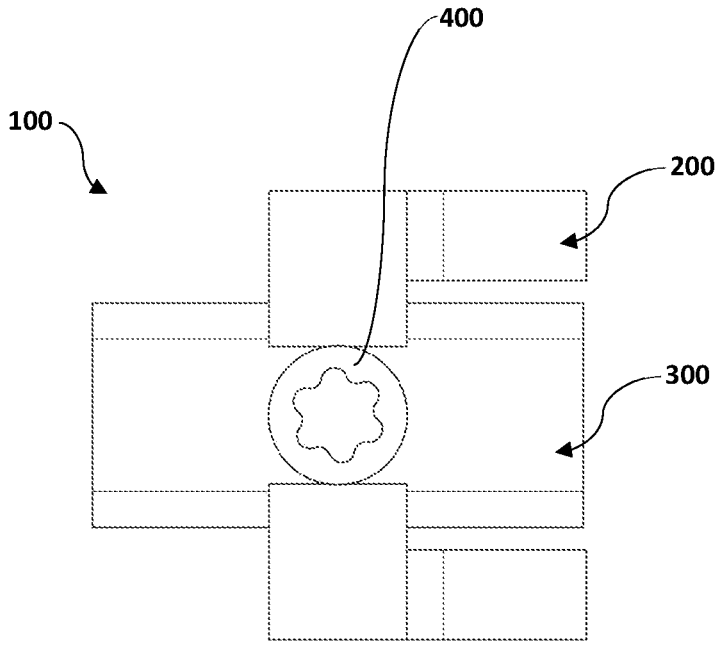
FIG. 8 illustrates a top view of deck clip of FIG. 1 together with a fastener.

FIGS. 7 and 8 illustrate the deck clip 100 selectively assembled with a fastener 400 partially inserted. As shown in FIG. 7, when the deck clip 100 is selectively assembled, the cross section 305 of the grip 300 may be selectively inserted within the channel 250 of the spacer 200.

In some embodiments, when the deck clip 100 is selectively assembled, the mating surfaces 360 of the grip 300 may abut the top surface 212 of the spacer 200; the inner surface 325 of the center portion 330 of the grip 300 may abut the upper surface 222 of the protrusion 220 of the spacer 200; and the outer surfaces 320 of the first leg portion 340 and the second leg portion 345 of the grip 300 may be abut the first arm member 230 and the second arm member 240 of the spacer 200. Moreover, the outer surface 320 of the center portion 330 of the grip 300 may partially abut the first cantilever member 232 and the second cantilever member 242 of the spacer 200. In other embodiments, a dimension of the channel 250 may be slightly larger such that at least some surfaces of the grip 300 do not abut the spacer 200.

As best shown in FIG. 8, when the deck clip 100 is selectively assembled, the second fastening hole 335 of the grip 300 may align axially with the first fastening hole 224 of the spacer 200 such that the fastener 400 can be inserted therethrough. When a fastener 400 is inserted therethrough, the fastening nubs 226 may act to retain the fastener 400 within the first fastening hole 224.

Figure 9:
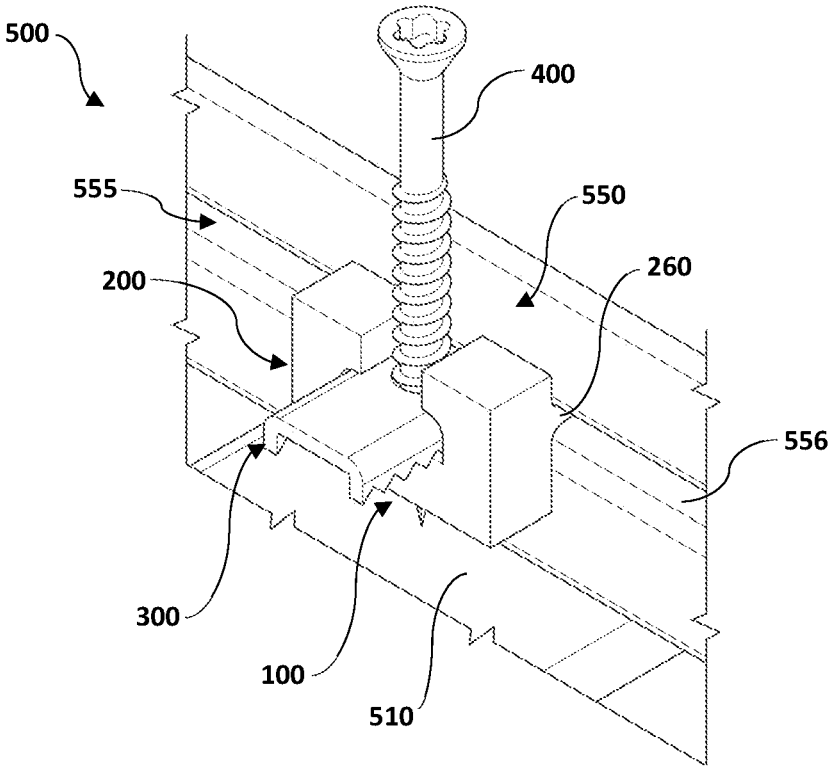
FIG. 9 illustrates a perspective view of a deck assembly partially assembled according to an example embodiment.
Figure 10:
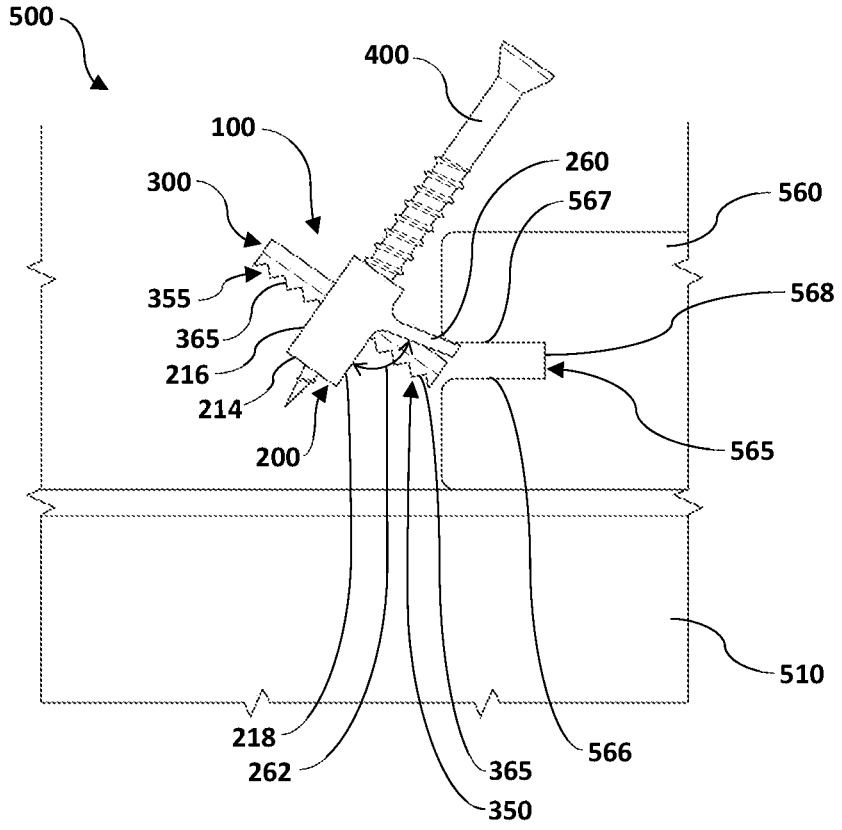
FIG. 10 illustrates a side view of a first step of assembling the deck assembly of FIG. 9.

FIG. 9 illustrates an enlarged view of a partially assembled deck assembly 500. The deck assembly 500 may include joists 510 (only one shown). Spanning across and resting on top of the joists 510, deck boards 550 (only one shown) may be provided. The joists 510 and the deck boards 550 may be made of wooden materials. In some embodiments, the deck boards 550 may be composite boards including a blend of multiple materials, such as a blend of wood and plastic.

In an example embodiment, each deck board 550 may include one or more grooves 555 (only one shown) that run longitudinally along the length of the deck boards 550. The grooves 555 may be pockets with a bottom groove face 556, and a top groove face (not shown) that is parallel to and opposite from the bottom groove face 556. In some embodiments, the grooves 555 may be substantially rectangular pockets, although a curved pockets or other geometries are also contemplated. The grooves 555 may also include a side groove face (not shown) that is orthogonal to both the bottom groove face 556 and the top groove face.

As shown in FIG. 9, the deck assembly 500 may include deck clips 100 (only one shown) with fasteners 400. The deck clips 100 may be positioned directly above the joists 510. The first extensions 260 and the second extensions 270 of the spacers 200 of the deck clips 100 may be positioned within the grooves 555 of the deck boards 550. The grips 300 of the deck clips 100 may also be positioned within the grooves 555 of the deck boards 550.

FIGS. 10-13 illustrate a method of assembling the deck assembly 500. First, a joist 510 may be provided. A first deck board 560 may be provided perpendicular to and on top of the joist 510. The first deck board 560 may be substantially the same as the deck boards 550 previously described. Similar to the deck boards 550, the first deck board 560 may include two grooves 565, each with a bottom groove face 566, a top groove face 567, and a side groove face 568.

Therefrom the deck clip 100 may be inserted into the first deck board 560. More particularly, the first extension 260 and the second extension 270 of the deck clip 100 may be inserted into the groove 565 of the first deck board 560. The first extension 260 and the second extension 270 may be introduced into the groove 565 while the deck clip 100 is angled (i.e., the top surface 212 of the spacer 200 is not parallel to the joists 510).

Figure 11:
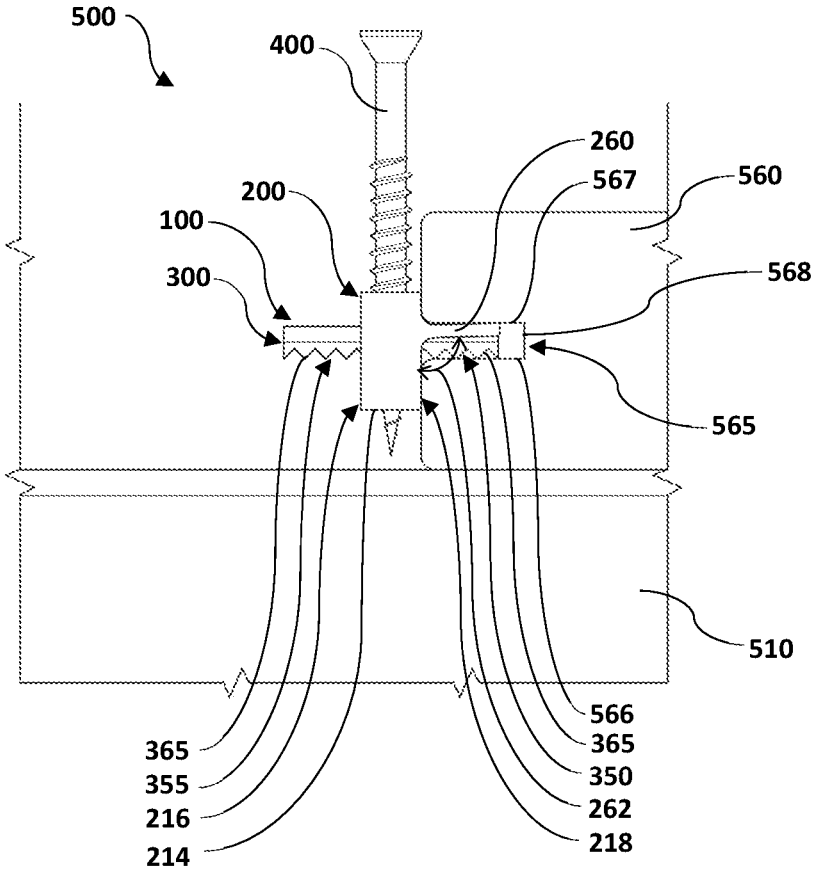
FIG. 11 illustrates a side view of a second step of assembling the deck assembly of FIG. 9.

Next, as illustrated in FIG. 11, the first end region 350 of the grip 300 may also be inserted into the groove 565 of the first deck board 560. This may be accomplished by rotating the deck clip 100 such that the deck clip 100 is no longer angled (i.e., rotating the deck clip 100 until the top surface 212 of the spacer 200 is parallel with the joists 510).

As the grip 300 of the deck clip 100 is inserted into the groove 565, the first extension 260 and the second extension 270 abut the top groove face 567, and the grip 300 abuts the bottom groove face 566. Resulting in the groove 565 imparts a sheer force onto the first extension 260 and the second extension 270. Said sheer force may cause the first tapered portion 264 and the second tapered portion 274 to undergo elastic deformation such that the first angle 262 and the second angle 272 decrease from approximately 104 degrees to approximately 90 degrees.

Accordingly, as the grip 300 is inserted into the groove 565, the first extension 260 and the second extension 270 are forced into the top groove face 567, and the grip 300 is forced into the bottom groove face 566. Thus, a friction created by an expansive force may be applied between the bottom grove face 566 and the grip surface 365 to prevent the grip 300 from easily disengaging the first deck board 560. Thereafter, the grip 300 may be further inserted into the groove 565 until the rear surface 218 of the spacer 200 abuts the first deck board 560.

Figure 12:
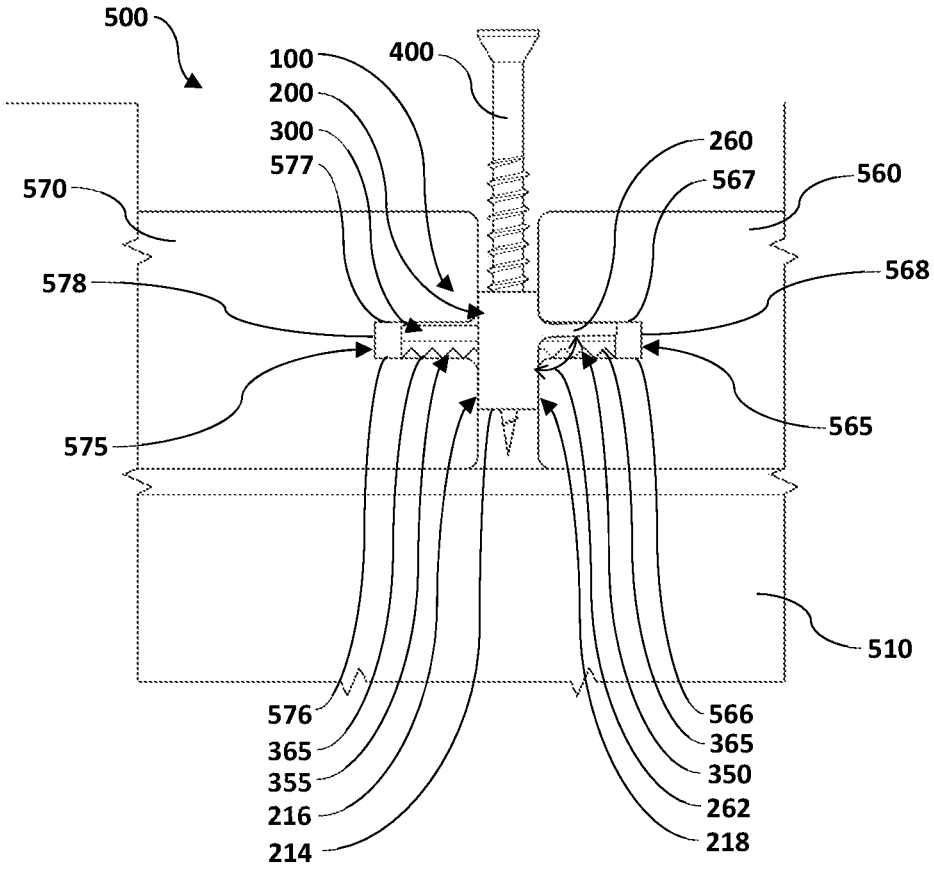
FIG. 12 illustrates a side view of a third step of assembling the deck assembly of FIG. 9.

Next, as illustrated in FIG. 12, a second deck board 570 may be introduced. The second deck board 570 can be quickly and accurately positioned by ensuring the front surface 216 of the spacer 200 abuts the second deck board 570.

Similar to the first deck board 560, the second deck board 570 may include two grooves 575 each with a bottom groove face 576, a top groove face 577, and a side groove face 578. Also similar to the first deck board 560, the grip 300 of the deck clip 100 may be inserted within the groove 575 of the second deck board 570. Here, however, it is the second end region 355 of the grip 300 that may be inserted into the groove 575. Similar to before, the grip surface 365 of the grip 300 may also abut the bottom groove face 576 of the second deck board 570. Accordingly, a firm connection between the deck clip 100 and the second deck board 570 may be formed.

Figure 13:
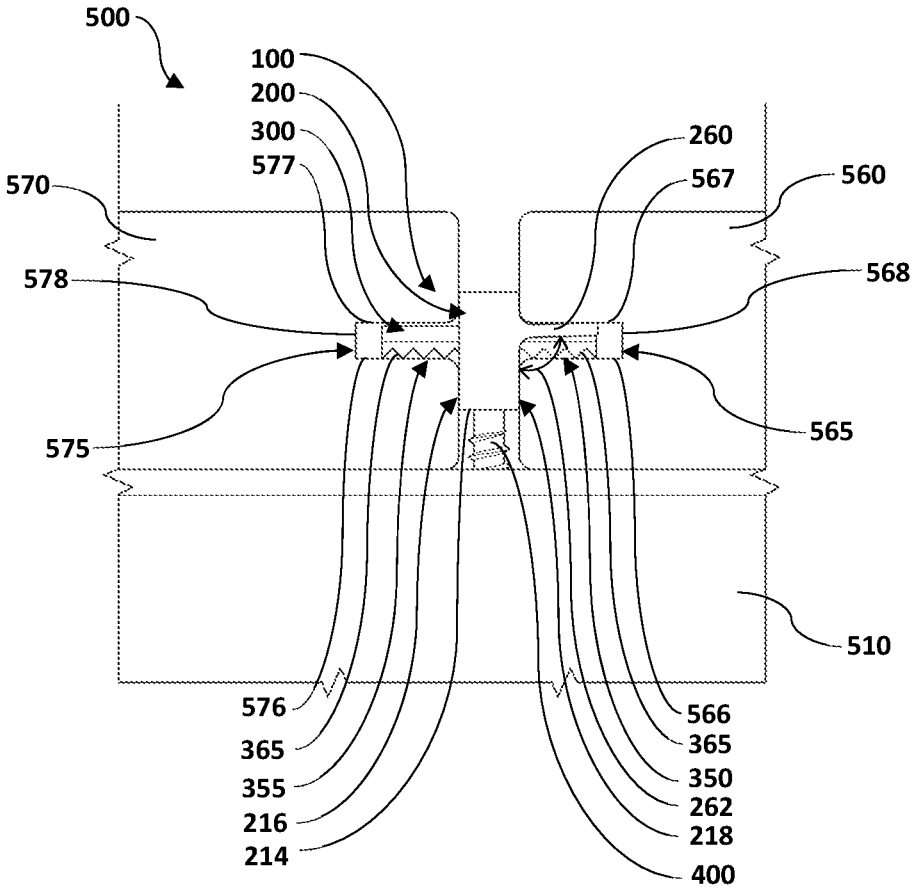
FIG. 13 illustrates a side view of a fourth step of assembling the deck assembly of FIG. 9.

Finally, as illustrated in FIG. 13, a fastener 400 may be utilized to affix the deck clip 100 to the joists 510. In the example embodiment, the fastener 400 may be a screw; however, other fastening means are foreseeable. Here, the fastener 400 may be inserted into and through the first fastening hole 224 of the spacer 200 and the second fastening hole 335 of the grip 300. Further, the fastener 400 may be inserted or screwed into the joists 510 to affix the deck clip 100 to the joist 510, thus creating a secured connection between the joists 510 and the deck clip 100. As can be appreciated, a distance between the front surface 216 and the rear surface 218 of the spacer 200 may defines the spacing between the first deck board 560 and the second deck board 570.

Once the fastener 400 is inserted into the joists 510, the downward force asserted due to the fastener 400 may cause the grip surface 365 to sink into or embedded itself in the bottom groove face 566 the first deck board 560, thus forming a secured connection. Further, by having the fastener 400 inserted into and through both the first fastening hole 224 of the spacer 200 and the second fastening hole 335 of the grip 300, the grip 300 can be held firmly in place (both vertically and horizontally) relative to the spacer 200, thus forming the deck clip 100.

A quick and secure connection may be provided between the joists 510, the first deck board 560, and the second deck board 570 without any fasteners 400 being exposed. The steps described herein can then be repeated until the desired number of deck boards 550 are connected to form the deck assembly 500 of the desired size. In each subsequent iteration of the steps, the so-called second deck board of the previous iteration may become the so-called first deck board in the subsequent iteration. Finally, when the process is completed, the deck assembly 500 may be securely formed without having exposed fasteners. Because the fasteners may be hidden in the grooves well below the top surface of the deck boards, the fasteners may be difficult to see by an end user, thus the top surface of the deck board can remain clear of any fasteners detracting from the appearance.

Further, because the deck clip 100 may be held in the deck boards alone through a friction fit due to an expansive force applied by the grip 300 and the first extension 260 and/or the second extension 270 of the spacer 200, multiple deck boards may be placed before having to fasten the deck clip 100 into the joists 510 via the fastener 400. Resulting in an increased ease of installation and efficiency.

Specific embodiments of a deck clip according to the present invention have been described for the purpose of illustrating the manner in which the invention may be made and used. It should be understood that the implementation of other variations and modifications of this invention and its different aspects will be apparent to one skilled in the art, and that this invention is not limited by the specific embodiments described. Features described in one embodiment may be implemented in other embodiments. The subject disclosure is understood to encompass the present invention and any and all modifications, variations, or equivalents that fall within the spirit and scope of the basic underlying principles disclosed and claimed herein.

What is claimed is:

1. A deck clip, comprising:

a grip configured to be received, when installed, between a top groove face and a bottom groove face of a first groove positioned on a side surface of a first deck board and between a top groove face and a bottom groove face of a second groove positioned on a side surface of a second deck board facing the first groove of the first deck board;

a spacer comprising:

a central member having a first end and a second end;

a first arm member extending vertically from the first end of the central member;

a second arm member extending vertically from the second end of the central member, wherein at least a portion of the first arm member and at least a portion of the second arm member are separated by a channel that is configured to receive the grip therein;

a first cantilever member extending from the first arm member toward the second arm member and ending in a first face, and a second cantilever member extending from the second arm member toward the first arm member and ending in a second face, wherein at least a portion of the first face of the first cantilever member and at least a portion of the second face of the second cantilever member comprise planar surfaces that are parallel with one another and are separated by a space narrower than the channel and configured to fit a fastener therebetween; and a first extension that extends outwardly with respect to at least one of a front surface or a rear surface of the spacer, wherein at least a portion of the first extension is configured to bend and, when installed, to press against one of the top groove face or the bottom groove face of the first groove and not to press against both the top groove face and the bottom groove face of the second groove;

wherein the at least portion of the first extension that is configured to bend is inclined with respect to the first arm member, wherein the vertical thickness of the inclined portion of the first extension is smaller at a region that is configured to contact the groove compared to a region of the inclined portion that is not configured to contact any groove when installed, wherein the region of the inclined portion that is not configured to contact any groove when installed is immediately adjacent the region of the inclined portion that is configured to contact the groove;

wherein the first extension is configured so that, when it is received within the groove, the first extension bends toward a plane aligned with the grip and an expansive force is applied by the combination of the grip and the first extension contacting respective faces of the groove.

2. The deck clip of claim 1, further comprising a second extension that extends outwardly with respect to at least one of a front surface or a rear surface of the spacer, wherein at least a portion of the second extension is configured to bend and, when installed, to press against one of the top groove face or the bottom groove face of the first groove and not to press against both the top groove face and the bottom groove face of the second groove.

3. The deck clip of claim 2, wherein the at least portion of the second extension that is configured to bend is inclined with respect to the second arm member, wherein the vertical thickness of the inclined portion of the second extension is smaller at a region that is configured to contact the groove compared to a region of the inclined portion that is not configured to contact any groove when installed, wherein the region of the inclined portion that is not configured to contact any groove when installed is immediately adjacent the region of the inclined portion that is configured to contact the groove.

4. The deck clip of claim 3, wherein the second extension is configured so that, when it is received within the groove, the second extension bends toward a plane aligned with the grip and an expansive force is applied by the combination of the grip and the second extension contacting respective faces of the groove.

5. The deck clip of claim 1, wherein the first extension is at least partially positioned above the grip.

6. The deck clip of claim 1, wherein the first cantilever member extends to a sharp corner with the first face such that there is no radius between the first cantilever member and the first face, and the second cantilever member extends to a sharp corner with the second face such that there is no radius between the second cantilever member and the second face.

7. The deck clip of claim 1, wherein the central member includes at least one fastening hole configured to receive the fastener.

8. The deck clip of claim 1, wherein a longitudinal axis of the first extension lies at an angle to at least one of the front surface and the rear surface of the spacer, and wherein said angle is approximately between 100 degrees and 110 degrees when the first extension is not acted on by external forces.

* * * * *